US005204729A

United States Patent [19]

Maeda et al.

[11] Patent Number: 5,204,729

[45] Date of Patent: Apr. 20, 1993

[54] FULL COLOR COPYING MACHINE

[75] Inventors: Yasutaka Maeda, Ikoma; Taisuke Kamimura, Kitakatsuragi; Hideyuki Nishimura, Yamatokoriyama; Tsuyoshi Miyamoto, Osaka; Katsuhiro Nagayama, Yamatokoriyama; Natsuko Tanaka, Fukuoka; Yuichi Kazaki, Yamatokoriyama, all of Japan

[73] Assignee: Sharp Kabushiki Kaisha, Osaka, Japan

[21] Appl. No.: 638,296

[22] Filed: Jan. 7, 1991

[30] Foreign Application Priority Data

Jan. 23, 1990 [JP] Japan ..... 2-14307
Oct. 31, 1990 [JP] Japan ..... 2-296309

[51] Int. Cl.[5] ..... G03G 15/01

[52] U.S. Cl. ..... 355/326; 355/214; 355/229

[58] Field of Search ..... 355/326, 327, 214, 239, 355/233, 71, 61, 35, 218, 244, 328; 346/38, 108, 160; 358/455

[56] References Cited

U.S. PATENT DOCUMENTS 3,967,894 7/1976 Tsilibes .
4,003,649 1/1977 Goren et al. .
4,014,607 3/1977 Cherian ..... 355/218 X
4,066,351 1/1978 Kidd ..... 355/69 X
4,436,410 3/1984 Komiya ..... 355/69 X
4,557,596 12/1985 Müller et al. ..... 355/132
4,757,351 7/1988 Birgmeir ..... 355/38
4,910,537 3/1990 Nezu ..... 346/160
4,935,770 6/1990 Driessen ..... 355/229 X
4,974,017 11/1990 Terashita ..... 355/38

FOREIGN PATENT DOCUMENTS 4426596 11/1969 Japan .

*Primary Examiner*—A. T. Grimley
*Assistant Examiner*—T. A. Dang
*Attorney, Agent, or Firm*—David G. Conlin; Donald R. Castle

[57] ABSTRACT

A full color copying machine which includes intermediate transfer medium whereon toner images having respective color components, formed on a photoreceptor are transferred to form one color toner image, and a screen filter disposed so as to be freely inserted or removed in or from a path of exposure light, which filters the exposure light for exposing the photoreceptor into a pattern of lines. A plurality of color toner images obtained by executing a plurality of copying processes based on a plurality of exposures applied to an original document are superposed on the intermediate transfer medium to form a color toner image. The copying machine further includes a screen mode for inserting a screen filter into a path of exposure light and a normal mode for removing the screen filter from the path of exposure light. Thus, exposures intended for low density components and high density components in an original document image are respectively performed by the use of the different modes, or they are respectively performed by changing setting conditions of the screen filter in the screen mode. With these arrangements, efficient application of the exposure device and high quality of the copied images can be achieved.

16 Claims, 11 Drawing Sheets

FULL COLOR COPYING MACHINE

FIELD OF THE INVENTION

The present invention relates to a full color copying machine provided with a screen filter which filters light for exposing a photoreceptor into a pattern of lines.

BACKGROUND OF THE INVENTION

One of the important technical subjects in full color copying machines is to enlarge the dynamic range for copying images in order to achieve the overall fidelity of color reproduction. Explained using a $\gamma$ characteristic curve showing the relation between an original document density and a copied image density, for example, as shown by a curve L in FIG. 15, the dynamic range is given by a maximum value of the original document density within a range wherein the curve L has a sloped portion, and is used as a measure for indicating tone gradations. In normal cases the dynamic range is as small as 0.6, far from an optimal value of 2.0, and the value is not satisfactory in practical use in terms of reproducibility of colors.

For that reason, attempts have been made to enlarge the dynamic range by the use of the simplest methods, such as adjustment of an exposure light amount or adjustment of a surface voltage of a photoreceptor. However, those methods have a problem that a copied image tends to get entirely faded due to lowering of saturated density.

In order to solve the problem, conventionally, those methods such as superposition method and screen method have been formulated and come into practical use. In the superposition method, as is shown in FIG. 15, it is arranged that the characteristic curve L for a copied image may be brought near an optimal curve shown by an alternate long and two short dashes line in FIG. 15 (where an original document density coincides with a copied image density), by superposing an image with low density components which has characteristics indicated by a curve G and an image with high density components which has characteristics indicated by a curve H. The superposition method provides copied images having, for example, a large dynamic range of substantial 1.0 to 1.2, and also permits a higher saturated density, thereby improving tone gradations, especially in high density portions.

On the other hand, in the screen method, as is illustrated in FIG. 16(*a*), a screen filter 43 which is installed at a vicinity of a photoreceptor 42 charged by a main charger 41, is adapted to filter light for exposure reflected from an original document into a pattern of lines, and as is illustrated in FIG. 16(*b*), tone gradations which are dependent upon a width of the lines of the screen filter 43 can be provided to a copied image. By using the screen method, a $\gamma$ characteristic is shifted as is indicated by a curve J in FIG. 17, and brought closer to the optimal curve in its low density portion compared with a curve K indicating a normal $\gamma$ characteristic, thereby improving tone gradations in its low density portion. Consequently, a comparatively large dynamic range of substantial 0.8 to 1.0 can be obtained.

In the superposition method, although the saturated density of copied images is increased in their high density portion, no treatment is applied to improve tone gradations in their low density portion. Consequently, since the method can not provide good tone gradations within original document image densities of substantial 0.1 to 0.5, it fails to clearly reproduce low density portions to be used for portraying human faces or other objects.

Moreover, in the screen method, since an exposure is performed through a screen filter on an entire area having different densities, an amount of exposure light is extremely attenuated. Accordingly, it is difficult to apply screen filters in practical use, especially, to full color copying machines wherein light is subjected to color separation before exposure. Further, in the case where an original document image is composed of characters, lines, or the like as is illustrated in FIG. 18(*a*), the screen method has a problem that a copied image obtained by exposure through a filter presents a dot-like appearance as illustrated in FIG. 18(*b*), and characters thereon are not clear and difficult to read.

In order to solve the above problems, a color copying machine disclosed by Japanese Patent Laid-Open Publication No. 206565/1987 (Tokukaisho 62-206565) is arranged to employ both of the superposition and screen methods. The color copying machine is provided with two exposing devices, and for the same original document image, one of the exposing devices having a larger amount of exposure light conducts a direct exposure, while the other exposing device having a smaller amount of exposure light conducts an exposure through a filter. Then the resulting electrostatic latent images are superposed on a photoreceptor.

The above color copying machine permits high tone gradations at a high density portion of a copied image by means of the direct exposure, while improving tone gradations at a low density portion thereof by the use of the screen filter. Moreover, the screen filter is not used for the high density portion where a larger amount of exposure light is required compared with the low density portion, and therefore it is not necessary to increase the amount of exposure light.

Furthermore, for an image containing many characters and lines, the exposure by the use of the screen filter is not performed, thereby improving sharpness of the image.

However, in the conventional color copying machine wherein electrostatic latent images are superposed on the photoreceptor a plurality of times, when the photoreceptor whereon an electrostatic latent image has been formed is uniformly charged, characters or lines contained in an original document image may become thinner due to the effect of the electrostatic latent image already formed. Further, the color copying machine should be provided with a plurality of exposure devices, thereby causing the number of parts to increase and the cost to become high.

SUMMARY OF THE INVENTION

It is an object of the present invention to provide a full color copying machine wherein an exposure device can be efficiently used.

It is another object of the present invention to provide a full color copying machine for supplying copied images with improved quality.

In order to achieve the above objects, a full color copying machine of the present invention includes intermediate transfer means whereon one color toner image is formed through the processes that toner images of respective color components formed on a photoreceptor are successively transferred thereon and a screen filter disposed so as to be freely inserted or removed in or from a path of exposure light, which filters light for exposing the photoreceptor into a pattern of lines. The copying machine is arranged in a manner such that one color toner image is formed by superposing a plurality of color toner images on the intermediate transfer means, and the plurality of color toner images are obtained through a plurality of copying processes which have been respectively performed according to a plurality of exposures for one original document image. Furthermore, as exposure modes for setting exposure conditions, the copying machine includes a screen mode for inserting the screen filter into the path of exposure light and a normal mode for removing the screen filter from the path of exposure light, whereby either of the exposure modes is selected, depending on the respective copying process.

Additionally, in the above arrangement, it is possible to conduct an exposure intended for low density components in an original document image by the use of screen mode, while conducting an exposure intended for high density components in the original document image by the use of the normal mode.

Moreover, in the screen mode, setting conditions of the screen filter may be changed.

In that case, each of the exposures intended for low density components and high density components may be performed under the different setting conditions of the respective filter.

Additionally, it is desirable to perform the exposure intended for high density components prior to that intended for low density components.

With the above arrangement, a plurality of color toner images obtained through a plurality of copying processes are superposed on the intermediate transfer means to form one complete color toner image. Therefore, different from conventional methods wherein a plurality of electrostatic latent images are superposed, a problem that characters or lines contained in a copied image may become thinner due to the charge of photoreceptor in performing the second and later exposures, can be avoided.

Further, depending on a desired copying process, either of exposure modes, a screen mode or a normal mode, can be selected. Therefore, both modes of exposure with and without a screen filter are available by the use of a single exposure device. With the arrangement, reducing the number of parts and cutting cost can be achieved.

Moreover, since the exposure intended for high density components with the necessity of a large amount of exposure light can be performed by the normal mode without using the screen filter, it is avoidable to necessitate an extremely large amount of exposure light required for the exposure intended for high density components.

Furthermore, by varying the setting conditions of the screen filter in the screen mode, it is possible to reproduce an original document image with optimal tone gradations. For example, a color toner image to be formed on the intermediate transfer means has its saturated density decreased with high tone gradations, by bringing the screen filter closer to the photoreceptor in a copying process for low density components, and on the other hand has its saturated density increased with low tone gradations, by bringing the screen filter farther from the photoreceptor in a copying process for high density components. The adjustment of the tone gradations can be performed, for example, by changing a ratio of the width of shade portions (line-like portions) to that of light transmission portions with respect to the screen filter.

Moreover, color toner images can be formed by using respective screen filters having different setting conditions for dealing with respective low density components and high density components, and by superposing those color toner images, a desirable copied image can be obtained with its $\gamma$ characteristic brought closer to the optimal curve.

Meanwhile, in the case where exposures and copying processes intended for the low density components and the high density components are successively performed, and by superposing the respective color toner images, one complete color toner image is formed, it is desirable to perform the exposure and copying process intended for the high density components prior to the exposure and copying process intended for the low density components in order to prevent the following problems.

Toner images of respective color components, Y (yellow), M (Magenta) and C (cyan), each formed on the photoreceptor, are successively transferred to the intermediate transfer means to be superposed thereon. In that case, in transferring one of the toner images after the preceding transfer operation, a part of the toner image already transferred is re-transferred from the intermediate transfer means to the photoreceptor (backward transfer). This causes a problem that, for example, upon transferring the toner images of M and C, only substantial 70 percent of the toner image of Y firstly transferred might remain due to the re-transfer thereof.

Here, suppose that substantial 30 percent of respective toner images for high density portion and low density portion transferred on the intermediate transfer means are re-transferred onto the photoreceptor. In that case, even if the rate of the toner image re-transferred is the same, the image quality of the low density portion is affected to a greater degree than that of the high density portion since the total amount of toner deposit is smaller in the low density portion than in the high density portion.

Further, in the case where after a toner image intended for low density components having been formed, a toner image intended for high density components is superposed thereon, since charges are applied to the low density portion many times after the transfer process, re-transferring is apt to occur. On the other hand, in the case where after a toner image intended for high density components having been formed, a toner image intended for low density components is superposed, the number of times to apply charges to the low density portion after the transfer process becomes fewer than the above case, and therefore a possibility of occurrence of re-transferring can be reduced.

For the above reasons, exposures intended for high density components are performed prior to those intended for low density components.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a schematic side view illustrating an arrangement of a screen filter.

FIG. 2 shows a γ characteristic in the cases of using a screen mode and a normal mode.

FIG. 3 is a schematic side view illustrating an entire structure of a full color copying machine.

FIG. 4 is an explanatory drawing illustrating an arrangement of a screen filter.

FIG. 5 shows a γ characteristic in the case of only using a screen mode.

FIG. 6(*a*) is a schematic plan view illustrating a structure of a screen filter.

FIG. 6(*b*) is a schematic side view illustrating actions of a reflection mirror.

FIG. 7 is a graphic chart showing a relation of original document density and copied image density when an amount of exposure light is varied.

FIG. 8 is a graphic chart showing a relation of original document density and copied image density when only tone gradations are varied.

FIG. 9 is a graphic chart showing a relation of original document density and copied image density when tone gradations are varied and further a potential of a photoreceptor as well as an amount of exposure light is compensated.

FIG. 10 is a flow chart showing changing procedures of the tone gradations.

FIG. 11 is an explanatory drawing illustrating the manner in which each color toner is successively transferred.

FIGS. 12(*a*) and (*b*) are sectional explanatory drawings respectively illustrating re-transferring in a high density portion and in a low density portion.

FIGS. 13(*a*) and (*b*) are explanatory drawings illustrating the manner in which high density components and low density components are respectively transferred in that order.

FIGS. 14(*a*) and (*b*) are explanatory drawings illustrating the manner in which low density components and high density components are respectively transferred in that order.

FIG. 15 shows a γ characteristic in the case of using the superposition method.

FIG. 16(*a*) is an explanatory drawing illustrating an exposure light in the case of using a screen filter.

FIG. 16(*b*) is a perspective view illustrating an external appearance of the screen filter.

FIG. 17 shows a γ characteristic in the case of using the screen method.

FIGS. 18(*a*) and (*b*) are explanatory drawing illustrating the manner in which a character on an original document is reproduced in a dot-like state by the screen filter.

DETAILED DESCRIPTION OF THE EMBODIMENTS

Figure 1:
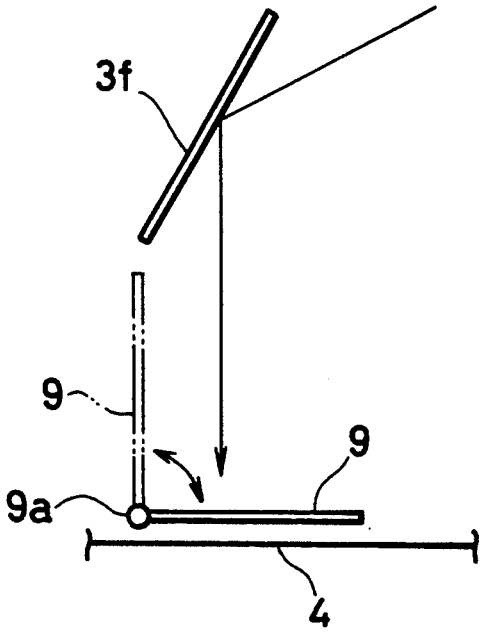
FIGS. 1 to 3 show one embodiment of the present invention.
Figure 2:
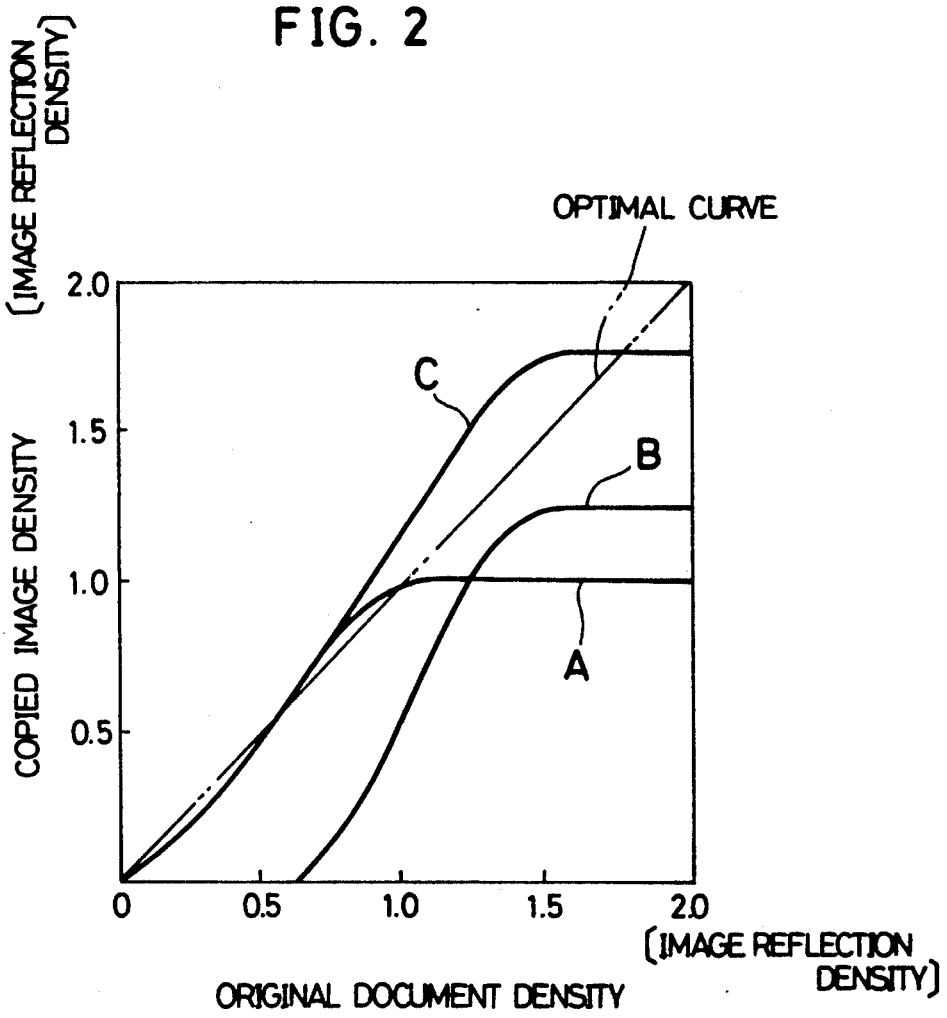
Figure 3:
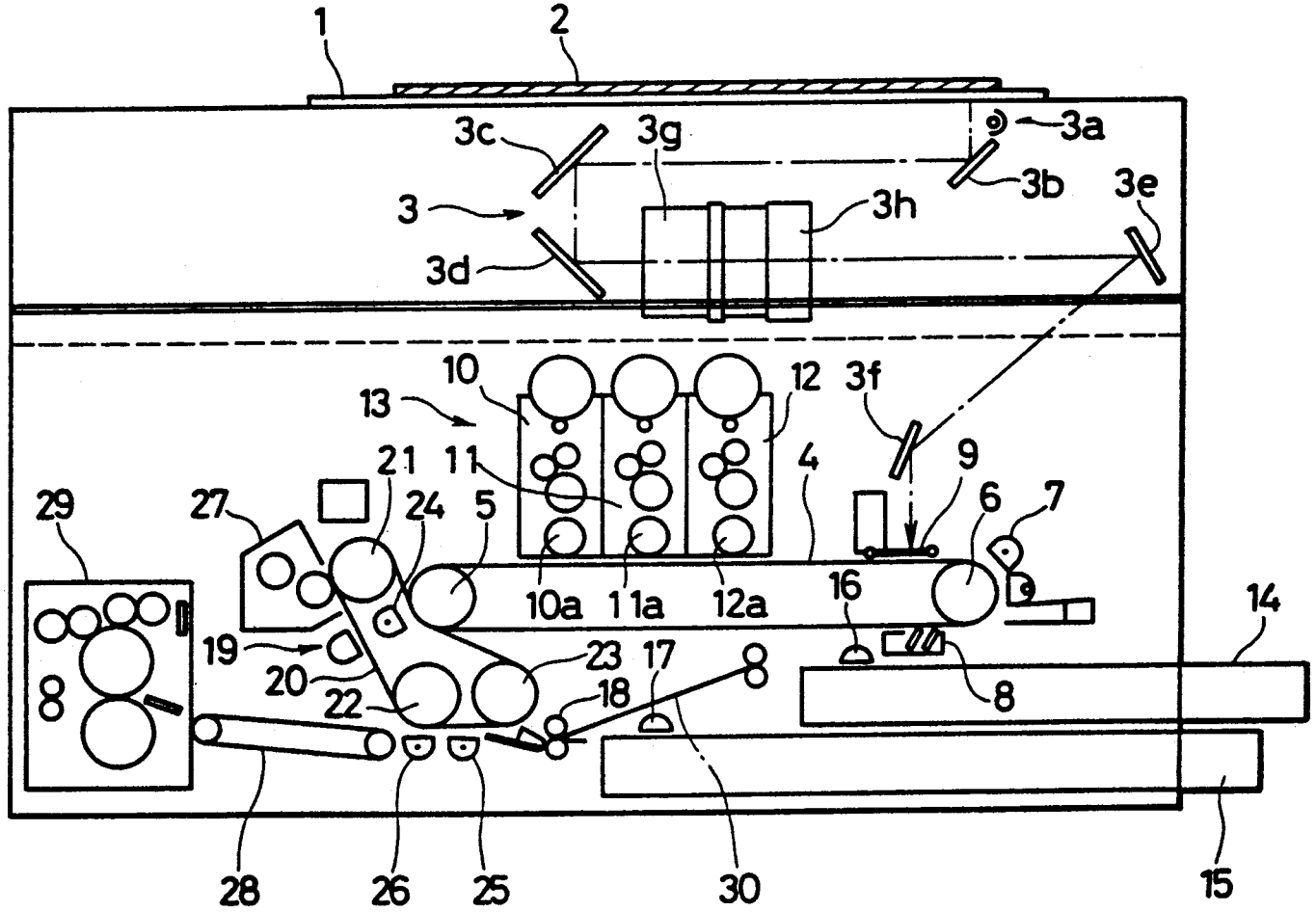

The following description will discuss one embodiment of the present invention referring to FIGS. 1 to 3.

As illustrated in FIG. 3, a full color copying machine (hereinafter referred to simply as copying machine) in accordance with the present invention is provided with a transparent document platen 1 on an upper surface thereof. Beneath the document platen 1, is disposed an optical system 3 which scans an original document 2 by the use of light and exposes a photoreceptor 4, which will be described later.

The optical system 3 includes a light source lamp 3*a* for illuminating the original document 2, a plurality of reflection mirrors 3*b* to 3*f* for directing the light reflected from the original document 2 onto the photoreceptor 4, for example, as is shown by an alternate long and short dash line in FIG. 3, an image-formation lens 3*g* and a color separation filter 3*h* having color filters of three primary colors, namely, red, green and blue, both disposed in a light path of the reflected light.

A belt-like photoreceptor 4 is installed beneath the optical system 3. The photoreceptor 4 is adapted to be engaged by two rollers 5, 6 disposed with a predetermined distance, and driven by a motor, not shown.

At a vicinity of the roller 6 relative to the photoreceptor 4, are installed a main charger 7 for charging the photoreceptor 4, a cleaning device 8 for eliminating toner remaining on the photoreceptor 4, a screen filter 9 for filtering the light reflected from the original document 2 into a pattern of lines, and other devices.

Above the upper surface of the photoreceptor 4, is disposed a developing device 13 having three developer tanks 10 to 12 without contacting with the photoreceptor 4. The developer tanks 10 to 12 are respectively provided with color developers of yellow, Magenta and cyan that are complementary colors to respective color filters in the color separation filter 3*h*, and furnished with respective magnet rollers 10*a* to 12*a* for applying the color developers to the photoreceptor 4.

On the other hand, paper feeding cassettes 14, 15 classified by sizes, for feeding transferring paper 30 are disposed one on the other beneath the photoreceptor 4. Feeding rollers 16, 17 are installed at the respective paper feeding sides of the feeding cassettes 14, 15. Further, in front of the feeding cassettes 14, 15, are installed a pair of timing rollers 18 which hold a sheet of transferring paper for a predetermined moment so as to feed it with a predetermined timing.

Moreover, an intermediate transfer device 19 is installed at the side of the roller 5 relative to the photoreceptor 4. The intermediate transfer device 19 includes a belt-like intermediate transfer medium 20 as intermediate transfer means, three rollers 21 to 23 for rotatively driving the intermediate transfer medium 20, a transferring charger 24 for transferring to the intermediate transfer medium 20 toner images independently having respective color components, formed on the photoreceptor 4, a transferring charger 25 for transferring to the transferring paper 30 a color toner image formed on the intermediate transfer medium 20, a separating charger 26 for separating the transferring paper 30 from the intermediate transfer medium 20, a cleaning unit 27 for eliminating toner remaining on the intermediate transfer medium 20, and other members.

In a paper ejecting path from the intermediate transfer medium 20, are installed a conveyor belt 28 for conveying the transferring paper 30, and a fixing device 29 for fixing the color toner image on the transferring paper 30.

In the copying machine arranged as described above, copying operation is controlled in such a manner that two copying processes are applied to an original document image, and color toner images obtained through the respective copying processes are superposed on the intermediate transfer medium 20 to form one complete color toner image. Further, the copying machine is arranged such that exposure can be performed by using either of two exposure modes; a screen mode wherein the screen filter 9 is inserted into a path of the light directed by the reflection mirror 3*f*, and a normal mode wherein the screen filter 9 is removed from the path of the light. Either of these exposure modes is selected, depending on each of the above copying processes. Additionally, since the screen filter 9 is permitted to freely pivot on a shaft 9*a* as is illustrated in FIG. 1(*a*), it can be inserted or removed in or from the path of the light.

Figure 16:
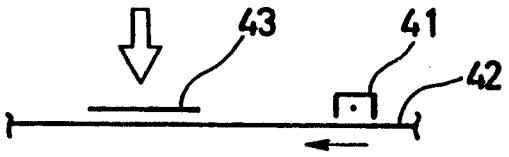
FIG. 16 (a) (PRIOR ART)
Figure 16:
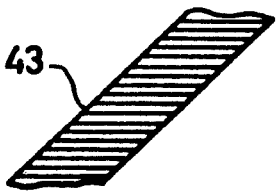
FIG. 16 (b) (PRIOR ART)
Figure 17:
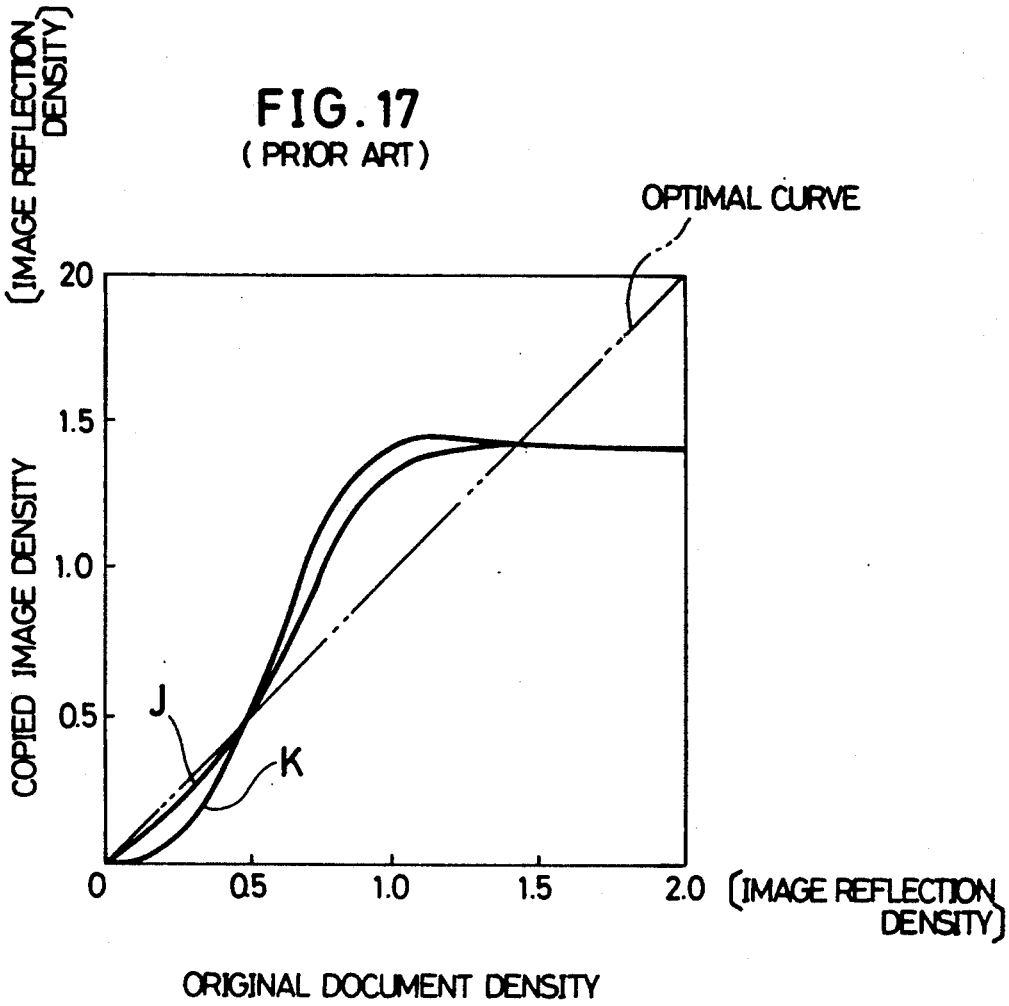
FIG. 17 (PRIOR ART)
Figure 18:
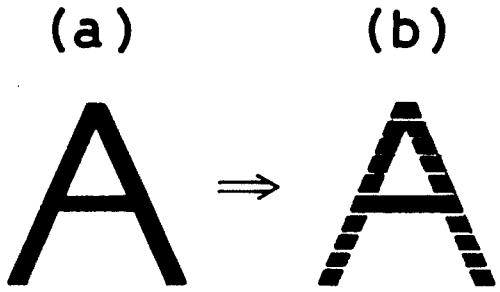
FIG. 18 (PRIOR ART)

The screen filter 9 as well as a screen filter 43 shown in FIG. 16(*b*), is composed of a transparent member such as, for example, polyethylene terephthalate, whereon a plurality of line portions colored black or the like so as not to transmit light are formed with a predetermined width.

In the above arrangement, when a full color copying operation is performed, the normal mode is firstly selected as the exposure mode, thereby removing the screen filter 9 from the path of the light. Under this condition, an exposure intended for high density components is started.

More specifically, the light source lamp 3*a* illuminates with light the original document 2 placed on the document platen 1, and scanning is performed by the light. This scanning operation is repeated three times. The light reflected from the original document 2 is directed to the color separation filter 3*h* through the reflection mirrors 3*b* to 3*d* and the image-formation lens 3*g*, and separated into each color component by the color separation filter 3*h*. Further, through the reflection mirrors 3*e*, 3*f*, the resulting lights having respective color components are successively projected onto the photoreceptor 4 uniformly charged by the main charger 7, thereby exposing the photoreceptor 4. Through the above steps, electrostatic latent images having the respective color components derived from the image of the original document 2 are independently formed on the photoreceptor 4.

The electrostatic latent images are respectively developed in the developing device 13 by the respective developers of yellow, Magenta and cyan that are complementary colors to respective color filters in the color separation filter 3*h*, and consequently become visible to form toner images of the respective colors. Then, the resulting toner images having respective color components are successively transferred and superposed onto the intermediate transfer medium 20 by charging from the transferring charger 24 in the intermediate transfer device 19. Through the above steps, one color toner image is obtained, and the first copying process intended for high density components is completed.

Next, the screen mode is selected in order to perform exposures intended for low density components, and the screen filter 9 is inserted into the path of the light from the optical system 3. Then, scanning is performed by light again as described above, and the light reflected from the original document 2, after having been filtered into a pattern of lines by the screen filter 9, is projected onto the photoreceptor 4, thereby exposing the photoreceptor 4.

The resulting electrostatic latent images obtained by the exposures are developed to form toner images having respective color components. These toner images are successively transferred onto the color toner image formed on the intermediate transfer medium 20 by the previous copying process, whereby another color toner image is formed. In this way one complete color toner image can be obtained by superposing two kinds of color toner images with each other.

The complete color toner image on the intermediate transfer medium 20 is transferred by charging from the transferring charger 25 onto a sheet of transferring paper 30 supplied by either one of the feeding cassettes 14, 15. Then, the transferring paper 30 is separated from the intermediate transfer medium 20 by the separating charger 26, and conveyed to the fixing device 29 by the conveyor belt 28, wherein the color toner image is fixed by heat treatment.

In this way, the present embodiment discloses that the low density components are exposed to form one portion of an image by exposures in the screen mode whose characteristics are shown by a curve A of $\gamma$ characteristic curves in FIG. 2, while the high density components are exposed to form the other portion of the image by exposures in the normal mode whose characteristics are shown by a curve B thereof. With the arrangement, a copied image finally obtained has its $\gamma$ characteristic shifted closer to an optimal curve shown by an alternate long and two short dashes line, and possesses the dynamic range of substantial 1.5 as is shown by a curve C, thereby resulting in improved tone gradations covering the entire range of densities.

Further, it is arranged that the screen filter 9 is not used for exposures intended for the high density components, and therefore sharpness of the image with respect to characters and lines can be improved. Furthermore, since one complete copied image is obtained by superposing color toner images, it is possible to avoid a problem that reproduced characters, lines, or the like might become thinner, which problem tends to occur in the case of superposing electrostatic latent images. Moreover, either the normal mode or the screen mode is selectable only by the use of one exposure device. Therefore it is not necessary to install a plurality of optical systems 3 as exposure devices, and reducing the number of parts and cutting cost can be achieved.

Meanwhile, after performing full color copying operations in accordance with the above processes under various copying conditions, it is found that copied images obtained under the following ranges of copying conditions show the most desirable tone gradations.

To be more concrete, when the high density components are exposed for the first copying process, the surface potential of the photoreceptor 4 should be set to −250 V to −350 V, and the developing bias voltage applied as voltage of magnet rollers 10*a*, 11*a*, 12*a* should be set to −80 V to −150 V. On the other hand, when the low density components are exposed for the second copying process by the use of the screen filter 9, the surface potential of the photoreceptor 4 should be set to −200 V to −300 V, and the developing bias voltage should be set to −80 V to −150 V as with the above process. In this case, a screen filter 9 having 100 to 133 line portions per inch, whose width ranges 50 to 70 μm, is employed, and the distance between the screen filter 9 and the photoreceptor 4 should be set to 1.0 to 1.8 mm.

Under the above copying conditions, copied images having optimal reproducibility can be obtained in the case where low density components ranging 0.1 to 0.6 in original document density are formed into an image through exposures by the use of the screen mode while high density components not less than 0.6 in original document density are formed into an image through exposures by the use of the normal mode, and the resulting images are superposed.

Further, with the arrangement wherein images are superposed, the exposure for low density components can be performed to fulfill copied image density of substantial 1.0 even in the case of using the screen filter 9, and even if an amount of exposure light is extremely decreased (for example, 20% thereof), the screen filter 9 can be used without any problem. Therefore, it is possible to make the surface potential of the photoreceptor 4 become lower than the surface potential (−500 V) of the conventional photoreceptor 4 required to obtain the normal copied image density (1.3 to 1.5), and the arrangement can minimize the required light amount. Consequently, even when an amount of exposure light is decreased, ample room for light amount can be provided to compensate for the decreased portion.

Figure 4:
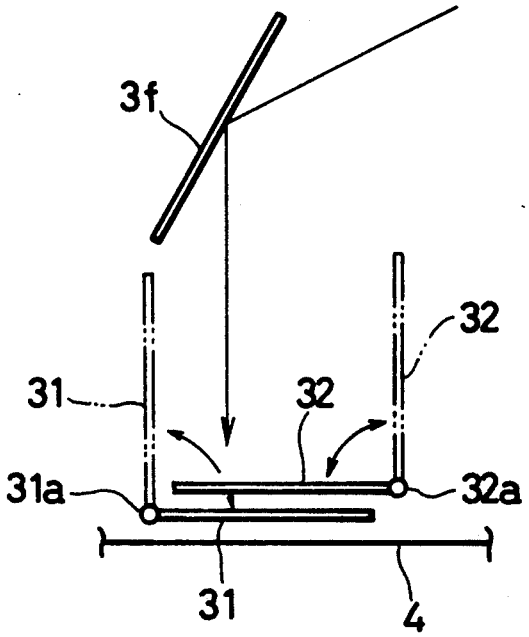
FIG. 4 and 5 show another embodiment of the present invention.
Figure 5:
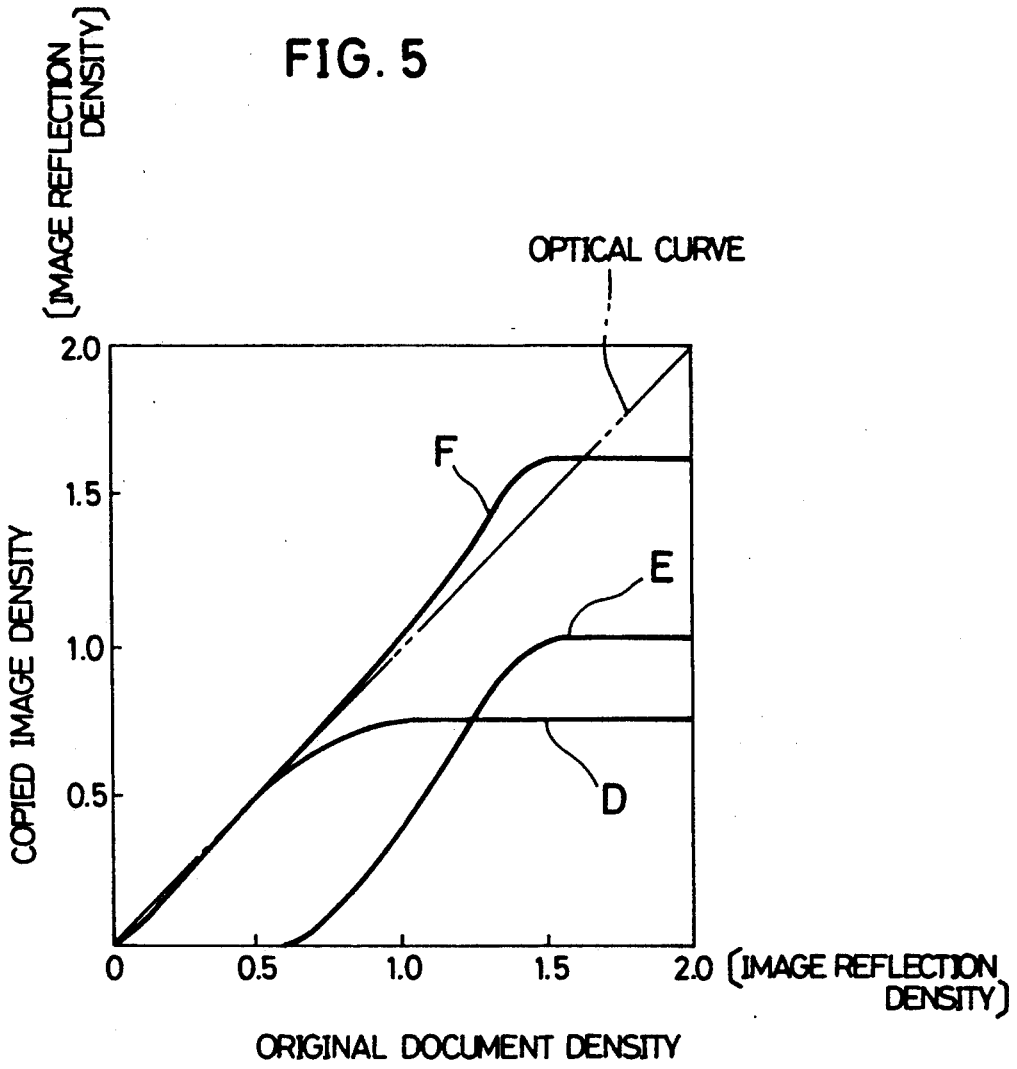

The following description will discuss another embodiment of the present invention referring to FIGS. 4 and 5. Additionally, those of the members having the same functions and described in the first embodiment are indicated by the same reference numerals and the description thereof is omitted.

In a copying machine in accordance with the present embodiment, screen filters 31, 32 as shown in FIG. 4 are installed at the same position as the screen filter 9 of FIG. 3. As with the screen filter 9, each of the screen filters 31, 32 is provided with a plurality of line portions (shade portions) formed thereon with predetermined intervals. The screen filters 31, 32 are permitted to freely pivot on the respective shafts 31*a*, 32*a* so as to be inserted or removed in or from a path of light projected to a photoreceptor 4.

When positioned in the path of the light, the screen filters 31, 32 have respective distances from the photoreceptor 4 (hereinafter called screen gaps) different from each other. The screen filter 31 is positioned at a height so as to have a smaller screen gap than that of the screen filter 32.

The screen filter 31 is adapted to be used for exposures intended for low density components, while the screen filter 32 is adapted to be used for exposures intended for high density components. Additionally, when a normal mode is selected as the exposure mode, both of the screen filters 31, 32 are removed from the path of the light.

In the above arrangement, the following description will discuss the operation where the screen mode is selected as the exposure mode.

When the screen mode is selected, the screen filter 32 is firstly selected with a view to performing exposures intended for high density components, and inserted into the path of exposure light, while the screen filter 31 is removed from the path. Thus, light projected from the optical system 3 is filtered into a pattern of lines by the screen filter 32, thereby exposing the photoreceptor 4. In this manner, by performing the exposure three times, electrostatic latent images having the respective color components are independently formed on the photoreceptor 4, and successively permitted to become visible as toner images having the respective color components. Then, the toner images are successively transferred onto an intermediate transfer medium 20 to form a color toner image, thereby completing the first copying process.

Next, the screen filter 31 is selected with a view to performing exposures intended for high density components, and inserted into the path of exposure light, while the screen filter 32 is removed from the path. Under this condition, scanning is performed by light in the same manner as described above, and the light reflected from an original document 2 is filtered into a pattern of lines by the screen filter 31, thereby exposing the photoreceptor 4. Then, electrostatic latent images having the respective color components, obtained through the exposures in this manner are developed, and successively superposed onto the color toner image on the intermediate transfer medium 20, obtained through the previous copying process. Thus, the two kinds of color toner images are superposed to produce one complete color toner image. Further, the color toner image is transferred onto a sheet of transferring paper 30, and a fixing treatment is applied thereto, thereby completing the full color copying operation.

As described above, in the present embodiment, since two exposures using different copying processes are performed by the screen filters 31, 32 disposed with different setting conditions in the case where the screen mode is selected, more improved tone gradation control is achieved compared with the aforementioned embodiment. For example, in the copying processes described above, the low density components are formed into an image having desired tone gradations by the exposure using the screen filter 31 as is shown by a curve D in FIG. 5, while the high density components are exposed to form an image having desired tone gradations by the exposure using the screen filter 32 as is shown by a curve E in FIG. 5.

With these processes, a copied image finally obtained has its $\gamma$ characteristic brought close to an optimal curve shown by an alternate long and two short dashes line such that they possess a dynamic range of substantial 1.5 as shown by a curve F in FIG. 5. Thus, sharpness of the image with respect to characters and lines can be improved.

Meanwhile, after performing full color copying operations in accordance with the above processes under various copying conditions, it is found that copied images obtained under the following ranges of copying conditions show the most desirable tone gradations.

The screen filters 31, 32 have the same number of line portions and width as the screen filter 9 of the aforementioned embodiment, and the screen gap of the screen filter 31 is set to 0.8 to 1.5 mm, while the screen gap of the screen filter 32 is set to 1.5 to 2.5 mm. Further, when the high density components are formed into an image for the first copying process, the surface potential of the photoreceptor 4 is set to −250 V to −350 V, and when the low density components are formed into an image for the second copying process, it is set to −250 V to −350 V. In both of the processes, the developing bias voltage is set to −80 V to −200 V.

Under the above copying conditions, copied images having optimal reproducibility can be obtained in the case where low density components ranging 0.1 to 0.6 in original document density are exposed to form an image by the use of the screen filter 31 while high density components not less than 0.6 in original document density are exposed to form an image by the use of the screen filter 32. Further, it is ensured that better copied images can be obtained by using the arrangement of the present embodiment not only in full color copying but also in mono-color copying.

Figure 6:
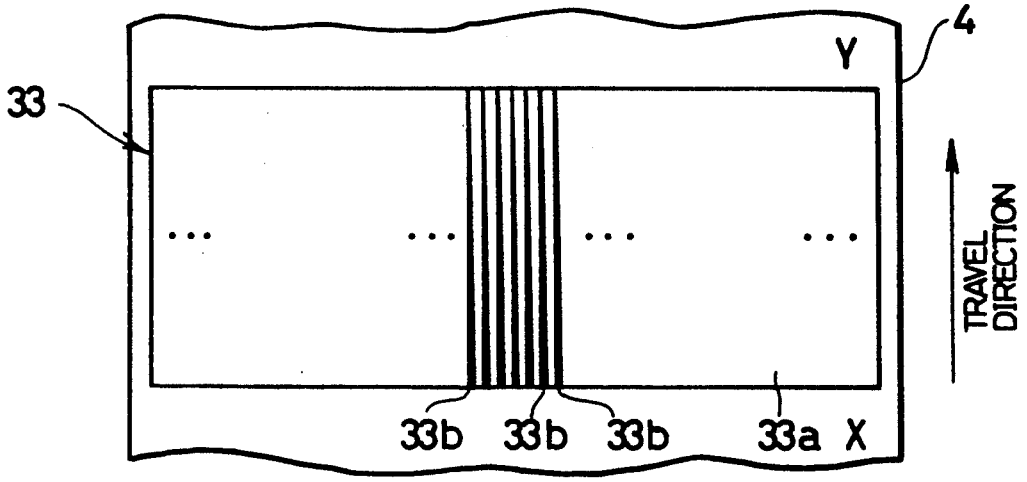
FIG. 6 shows still another embodiment of the present invention.
Figure 6:
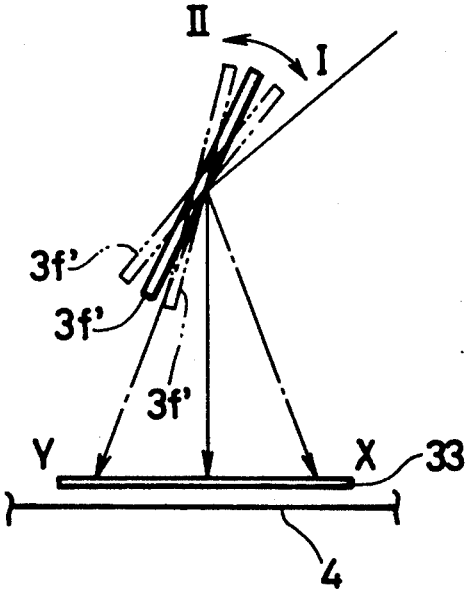

The following description will discuss another embodiment of the present invention referring to FIG. 6. Additionally, those of the members having the same functions and described in the first embodiment are indicated by the same reference numerals and the description thereof is omitted.

In a copying machine in accordance with the present embodiment, a screen filter 33 as shown in FIG. 6(*a*) is installed at the same position as the screen filter 9 of FIG. 3. The screen filter 33 is composed of a transparent member 33*a* made of a material such as polyethylene terephthalate, whereon a large number of line portions 33*b* are formed. The screen filter 33 is disposed at a positin with a predetermined screen gap, that is, a distance ranging, for example, 1.5±0.2 mm from a photoreceptor 4. Further, the screen filter 33 has its longitudinal direction perpendicular to the travel direction of the photoreceptor 4.

The line portions 33*b* are disposed forming a parallel array to the travel direction of the photoreceptor 4, and colored black so as not to transmit light. The width of the line portions 33*b* is set in such a manner that it is gradually changed within a range of 65±20 μm (45 to 85 μm). More concretely, the line portions 33*b* are formed with the width thereof increasing toward an X side upstream in the travel direction of the photoreceptor 4 and decreasing toward a Y side downstream in the travel direction of the photoreceptor 4. In addition, the line portions 33*b* are disposed at a rate of 110 per inch in number.

As illustrated in FIG. 6(*b*), above the screen filter 33 there is disposed a reflection mirror 3*f'* at the same position as the reflection mirror 3*f* of FIG. 3. The reflection mirror 3*f'* is adapted to be pivoted either in a direction I or in a direction II by pivot means (not shown). With the arrangement, an incident angle of light can be changed.

Accordingly, when the reflection mirror 3*f'* is located in a center position indicated by a solid line in FIG. 6(*b*), light is directed to a center portion of the screen filter 33. On the other hand, when the reflection mirror 3*f'* is inclined in the direction I, light is directed to the Y side of the screen filter 33, and when the reflection mirror 3*f'* is inclined in the direction II, light is directed to the X side of the screen filter 33. In other words, an incident position of light on the screen filter 33 is changed by inclining the reflection mirror 3*f'* in such a manner that the width of the line portions 33*b* can be changed depending on a position on the screen filter 33 through which the light transmits. When the reflection mirror 3*f'* is further inclined in the direction II, light is directly projected onto the photoreceptor 4 without transmitting through the screen filter 33.

In a copying machine in accordance with the present embodiment, when a screen mode is selected as an exposure mode, driving of the reflection mirror 3*f'* is controlled within a range where light can transmit through the screen filter 33 such that setting conditions of the screen filter 33 can be selected according to a desired copying process. On the other hand, when a normal mode is selected as an exposure mode, the driving of the reflection mirror 3*f'* is controlled so that no light can transmit through the screen filter 33. Further, in order to adjust saturated density of a copied image, a surface potential of the photoreceptor 4 can be adjusted within a range of 300±70 V, while a potential of the light source lamp 3*a* is compensated for within a range of a standard lamp voltage ±10 V.

In the above arrangement, an explanation will be made of the operation wherein the screen mode is selected as the exposure mode.

When the screen mode is selected, setting conditions of the screen filter 33 are determined, and accordingly the reflection mirror 3*f'* is driven to be inclined at a desired angle. Here, the explanation deals with the case where an exposure intended for the high density components is firstly performed by using an area of the screen filter 33 having the line portions 33*b* with a narrower width and then another exposure intended for the low density components is performed by using an area of the screen filter 33 having the line portions 33*b* with a wider width.

The reflection mirror 3*f'* is firstly inclined in the direction I, whereby light from an optical system 3 is filtered into a pattern of lines by the area of the screen filter 33 having the line portions 33*b* with a narrower width to expose the photoreceptor 4. Thereafter, electrostatic latent images independently formed on the photoreceptor 4, having the respective color components, are developed to form toner images having the respective color components. Then, a color toner image is formed by successively superposing the toner images on the intermediate transfer medium 20, thereby completing a first copying process.

Succeedingly, setting conditions of the screen filter 33 are changed, and the reflection mirror 3*f'* is inclined in the direction II, thus starting a next copying process. Then, light from the optical system 3 is filtered into a pattern of lines by the area of the screen filter 33 having the line portions 33*b* with a wider width to expose the photoreceptor 4. Thereafter, electrostatic latent images having the respective color components are obtained through exposures in this manner, and the resulting toner images obtained by developing those electrostatic latent images are successively transferred onto the color toner image formed on the intermediate transfer medium 20 through the previous copying process. With the process, the two kinds of color toner images are superposed to form one complete color toner image. Further, the color toner image is transferred onto a sheet of transferring paper 30, and a fixing treatment is applied thereto, thereby completing the full color copying operation.

As described above, the disclosure of the present embodiment is different from that of the aforementioned embodiment in that setting conditions of the screen filter 33 can be altered by allowing light to be directed to a different position on the screen filter 33 in a screen mode and making it possible to change the width of the line portions 33*b* by which the light is filtered into a pattern of lines. Further, in the present embodiment, switching of exposure modes can be easily performed only by driving the reflection mirror 3*f'*.

The following description will discuss still another embodiment of the present invention.

An object of the present embodiment is to provide tone gradations of copied images which are desirably and predeterminately set by the user by using the screen filter 33 of the aforementioned embodiment.

Figure 7:
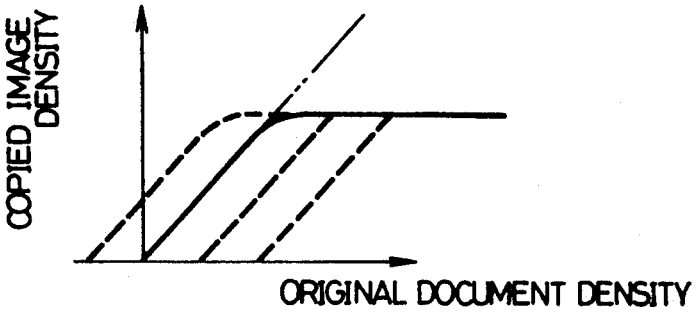
FIGS. 7 to 10 show a further embodiment of the present invention.

Normally, adjustment of copied image density is performed by adjusting voltage to be applied to the light source lamp 3*a* (see FIG. 3) and changing the amount of exposure light. More concretely, by changing the amount of exposure light, copied image density varies differently as shown by dotted lines in comparison with the standard density shown by a solid line in FIG. 7.

However, in this case although copied image density varies, no change is obtained in tone gradations.

On the other hand, in the present embodiment, tone gradations can be adjusted through processes wherein exposures are performed through the screen filter 33 and the width of the line portions 33b is permitted to change at a position through which light transmits.

Figure 8:
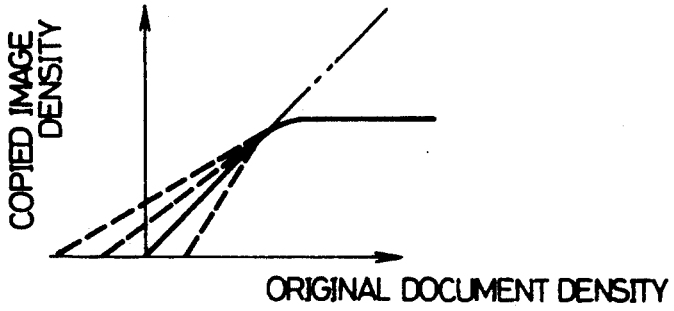

However, changing the width 33b of the screen filter 33 only permits tone gradations to vary in such a manner as shown by each dotted line in comparison with the standard tone gradations shown by a solid line in FIG. 8. In this case, since the characteristics of each dotted line deviate greatly from optimal characteristics for copied image density, it is not possible to obtain good copied images.

Figure 9:
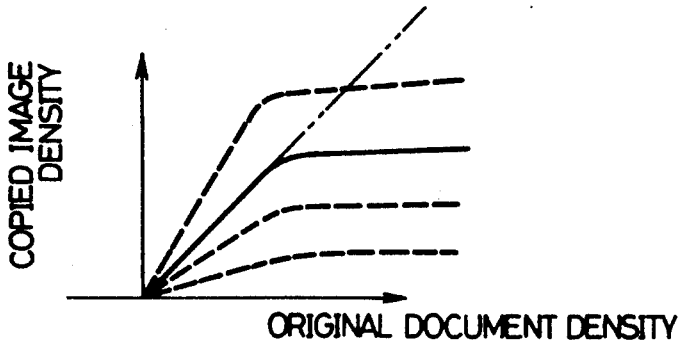

As against this, by changing a surface potential of the photoreceptor 4 and a lamp potential of the light source lamp 3a in addition to the changing of the width of the line portions 33b, tone gradations are adapted to vary in such a manner as shown by each dotted line in comparison with the standard tone gradations shown by a solid line in FIG. 9.

In order to raise tone gradations, a portion of the screen filter 33 having a wider width of the line portions 33b should be used, and the surface potential of the photoreceptor 4 should be lowered while the lamp potential of the light source lamp 3a should be raised.

On the other hand, in order to lower tone gradations, a portion of the screen filter 33 having a narrower width of the line portions 33b should be used, and the surface potential of the photoreceptor 4 should be raised while the lamp potential of the light source lamp 3a should be lowered.

Additionally, the width of the line portions 33b is selected, for example, within a range of 45 μm to 85 μm as aforementioned; the surface potential of the photoreceptor 4 is preset, for example, within a range of 230 V to 370 V; and the potential of the light source lamp 3a is preset within a range of a standard lamp potential ±10 V.

Figure 10:
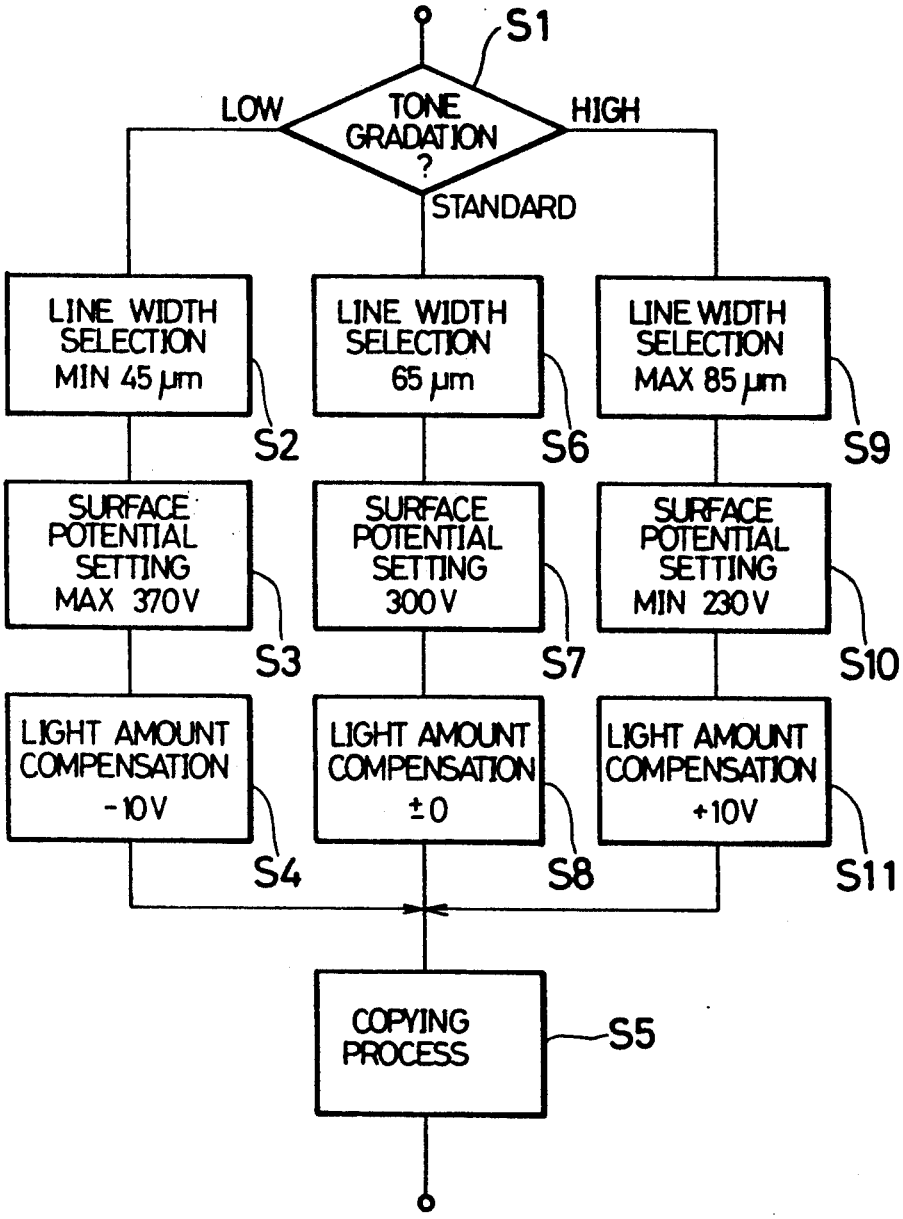

The following description will discuss the adjusting processes whereby tone gradations are adjusted to be set at any one of three levels, "low", "standard" and "high", referring to FIG. 10.

When the user makes a selection of tone gradations through a switch or other means, firstly it is determined which level of tone gradations is selected among "low", "standard" and "high" (S1).

If "low" is selected, a minimum value of 45 μm is selected as the width of the line portions 33b of the screen filter 33 (S2). Further, a maximum value of 370 V is preset as the surface potential of the photoreceptor 4 (S3), while a minimum value of a standard lamp potential −10 V is preset as the lamp potential of the light source lamp 3a (S4). After having been determined as described above, exposures are performed, a copying process is thus executed (S5).

If "standard" is selected as tone gradations at S1, a median 65 μm is selected as the width of the line portions 33b (S6). Further, a median 300 V is preset as the surface potential of the photoreceptor 4 (S7), while a standard lamp potential is preset as the lamp potential of the light source lamp 3a (S8), whereby a copying process is executed (S5).

If "high" is selected as tone gradations at S1, a maximum value of 85 μm is selected as the width of the line portions 33b (S9). Further, a minimum value of 230 V is preset as the surface potential of the photoreceptor 4 (S10), while a maximum lamp potential of a standard lamp potential +10 V is preset as the lamp potential of the light source lamp 3a (S11), whereby a copying process is executed (S5).

Additionally, in the above description it is arranged that the tone gradations are adjusted using the three levels, for convenience of explanation: yet, practically, adjustment ranging substantial ten levels may be available by adjusting the width of the line portions 33b, the surface potential of the photoreceptor 4 and other factors little by little. Moreover, stepless operation can be provided for adjusting tone gradations.

Figure 11:
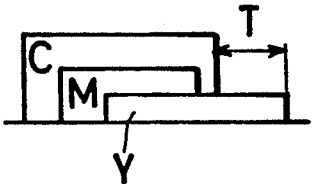
FIGS. 11 to 14 are drawings explaining re-transferring of toner from an intermediate transfer medium.

Meanwhile, in all the aforementioned embodiments, exposures and copying processes intended for the high density components are performed prior to those intended for the low density components. The reason is described as follows:

As illustrated in FIG. 11, toner images of respective color components, Y (yellow), M (Magenta) and C (cyan), each formed on the photoreceptor, are successively transferred to the intermediate transfer means to be superposed thereon. In that case, in transferring the toner images of M and C after the preceding transfer operation, a part of the toner image of Y already transferred is re-transferred from the intermediate transfer means to the photoreceptor (backward transfer). This causes a problem that, referring to the example of FIG. 11, within a range shown by T, only substantial 70 percent of the toner image of Y might remain due to the reduction caused by re-transfer thereof.

Figure 12A:
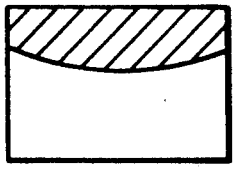
Figure 12B:
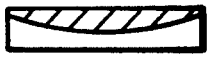

Here, as illustrated by respective hatching portions in FIGS. 12(*a*) and (*b*), it is supposed that substantial 30 percent of respective toner images transferred on the intermediate transfer means for high density portion and low density portion are re-transferred onto the photoreceptor. In that case, even if the rate of the toner images re-transferred is the same, the image quality of the low density portion is affected more adversely than that of the high density portion since the total amount of toner deposit is smaller in the low density portion illustrated in FIG. 12(*b*) than in the high density portion.

Figure 13A:
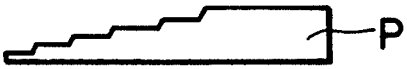
Figure 13B:
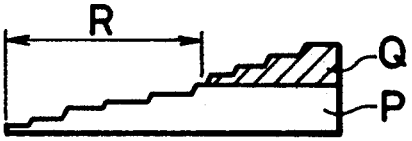
Figure 14A:
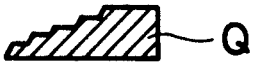
Figure 14B:
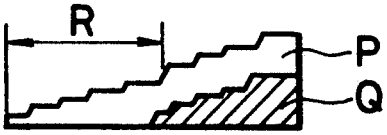
Figure 15:
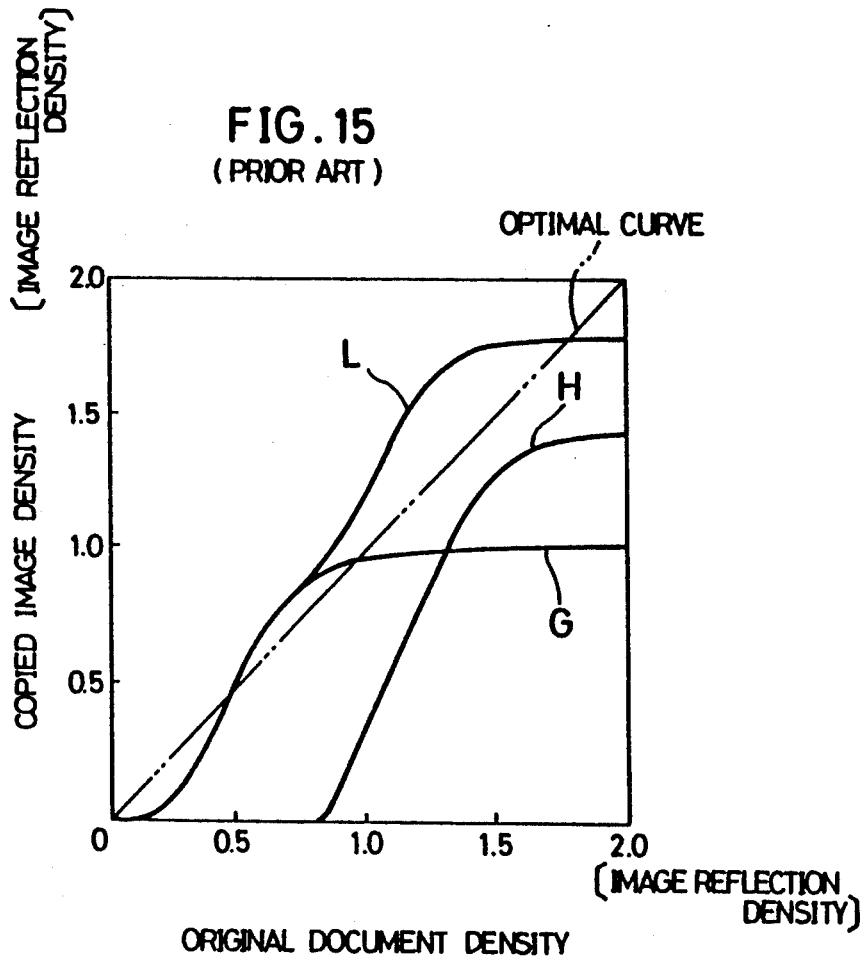
FIG. 15 (PRIOR ART)
FIGS. 15 to 18 show the prior art.

Moreover, FIGS. 13(*a*) and (*b*) illustrate the case where a toner image of the high density components Q is formed after a toner image of the low density components P has been formed in advance. In the case, since charges are applied to a range R many times after the transfer process, re-transferring is apt to occur. On the other hand, FIGS. 14(*a*) and (*b*) illustrate the case where a toner image of the low density components P is formed after a toner image of the high density components Q has been formed in advance. In the case, the number of times to apply charges to the range R after the transfer process becomes fewer than the above case, and therefore a possibility of occurrence of re-transferring can be reduced.

For the above reasons, it is desirable to perform exposures intended for the high density components prior to those intended for the low density components.

The invention being thus described, it may be obvious that the same may be varies in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A color copying machine for reading an image on a document having a high-density portion and a low-density portion and for forming a copied image on copy materia, the machine comprising:

scanning means for scanning an original document a plurality of times and forming corresponding pluralities of electrostatic latent images of both the high-density portion and low-density portion of the document, a screen filter, freely insertable into and removable from a path of light reflected from an original document, for filtering the reflected light into a pattern of lines, a photoreceptor upon which a plurality of electrostatic latent images of both the high-density portion and low-density portion are formed, first toner image forming means for forming a first color toner image from the plurality of the electrostatic images relating to the high-density portion, second toner image forming means for forming a second color toner image from the plurality of the electrostatic latent images relating to the low-density portion, complete toner image forming means for forming the copied image form a superposition of the first color toner image and the second toner image, whereby said screen filter is inserted into the path of the light when the plurality of electrostatic latent images of the low-density portion are formed.

2. A color copying machine according to claim 1, wherein an intermediate transfer means comprises a belt-like intermediate transfer medium receives the copied image.

3. A color copying machine according to claim 1, wherein the screen filter is designed to pivot on a shaft secured to an end portion of the screen filter, whereby the screen filter is inserted into the path of the reflected light upon selecting a first mode, and is removed from the path of the reflected light upon selecting a second mode.

4. A color copying machine according to claim 1, wherein an exposure related to the low-density portion in the document is executed upon selecting a first mode and an exposure related to the high-density portion in the document is executed upon selecting a second mode.

5. A color copying machine according to claim 4, wherein the exposure related to the high-density portion is executed prior to the exposure related to the low-density portion.

6. A color copying machine according to claim 4, having a changeable setting condition of the screen filter.

7. A color copying machine according to claim 6, wherein each exposure is executed with the screen filter having different setting conditions.

8. A color copying machine according to claim 7, comprising a first screen filter disposed at a relatively shorter distance from the photoreceptor and a second screen filter disposed at a relatively longer distance from the photoreceptor, whereby the first screen filter is used when the exposure related to the low-density portion in the document is executed and the second screen filter is used when the exposure related to the high-density portion in the document is executed.

9. A color copying machine according to claim 7, comprising a reflection mirror capable of freely pivoting, for directing exposure light to the photoreceptor, the screen filter having a plurality of shade portions, whereby the reflection mirror directs light to a position on the screen filter having shade portions with a relatively narrower width when the exposure related to the high-density portion is executed and directs light to a portion on the screen filter having shade portions with a relatively wider width when the exposure related to the low-density portion is executed.

10. A color copying machine according to claim 7, wherein the exposure for the high-density portion is executed prior to the exposure related to the low-density portion.

11. A method for forming color toner images in a color copying machine comprising:

removing a screen filter from a path of exposure light;

scanning an original document a plurality of times and forming on a photoreceptor a corresponding plurality of electrostatic latent images corresponding to a high-density portion of the document;

forming a plurality of toner images corresponding to the electrostatic latent images that correspond to the high-density portion of the document;

forming a first color toner image by superposing the plurality of toner images that correspond to the high-density portion;

inserting the screen filter into the path of the exposure light;

scanning the document a plurality of times and forming on the photoreceptor a corresponding plurality of electrostatic latent images of a low-density portion of the document;

forming a plurality of toner images corresponding to the electrostatic latent images that correspond to the low-density portion;

forming a second color toner image by superposing the plurality of toner images corresponding to the low-density portion; and forming a copied image by superposing the second color toner image and the first color toner image.

12. A method according to claim 11, wherein the color copying machine includes a lower screen filter disposed a relatively shorter distance from the photoreceptor and a higher screen filter disposed a relatively longer distance from the photoreceptor, and the step for forming the first color toner image comprises:

removing the lower screen filter from the path of exposure light while inserting the higher screen filter into the path of exposure light;

forming on the photoreceptor a plurality of electrostatic latent images, each having color components, by executing a plurality of exposures related to the high-density portion in the document;

forming toner images, each having color components derived from the plurality of electrostatic latent images; and forming the first color toner image by superposing the plurality of toner images.

13. A method according to claim 12, wherein the step for forming the second color toner image comprises:

removing the higher screen filter from the path of exposure light while inserting the lower screen filter into the path of exposure light;

forming on the photoreceptor a plurality of electrostatic latent images, each having color components, by executing a plurality of exposures related to the low-density portion in the document;

forming a plurality of toner images, each having color components corresponding to the plurality of electrostatic latent images; and forming the second color toner image by superposing the plurality of toner images.

14. A method according to claim 11, wherein the color copying machine is provided with a screen filter having a plurality of shade portions formed thereon and the step for forming the first color toner image comprises:

forming on the photoreceptor a plurality of electrostatic latent images, each having color components, by executing a plurality of exposures relating to the high-density portion in the document by employing shade portions with a relatively narrower width;

forming a plurality of toner images, each having color components, corresponding to the plurality of electrostatic latent images; and forming the first color toner image by superposing the plurality of toner images.

15. A method according to claim 14, wherein the step for forming the second color toner image comprises:

forming on the photoreceptor a plurality of electrostatic latent images, each having color components, by executing a plurality of exposures relating to the low-density portion in the document by employing shade portions with a relatively wider width;

forming a plurality of toner images, each having color components corresponding to the plurality of electrostatic latent images; and forming the second color toner image by superposing the plurality of toner images.

16. A method according to claim 15 wherein adjusting tone gradation in a color copying machine comprises:

selecting a tone gradation;

selecting a width of shade portion of a screen filter;

setting a surface potential of a photoreceptor; and setting a lamp potential of a light source lamp.

* * * * *